United States Patent [19]

Smith et al.

[11] 4,328,685

[45] May 11, 1982

[54] KNITTING MACHINES HAVING IMPROVED YARN SUPPLY ARRANGEMENTS

[75] Inventors: Arthur R. Smith; Denis J. Harris, both of Leicester, England

[73] Assignee: Wildt Mellor Bromley Limited, Leicester, England

[21] Appl. No.: 42,884

[22] Filed: May 29, 1979

[30] Foreign Application Priority Data

May 31, 1978 [GB] United Kingdom ..... 26040/78

[51] Int. Cl.[3] ..... D04B 15/42

[52] U.S. Cl. ..... 66/125 R; 242/131

[58] Field of Search ..... 66/125 R, 125 A; 242/131

[56] References Cited

U.S. PATENT DOCUMENTS 3,018,645 1/1962 Fried ..... 66/125 R
3,805,556 4/1974 Planck, Jr. et al. ..... 242/131 X
3,858,827 1/1975 Glassbrook ..... 242/131

FOREIGN PATENT DOCUMENTS 992088 5/1965 United Kingdom ..... 242/131

*Primary Examiner*—Wm. Carter Reynolds
*Attorney, Agent, or Firm*—Fishman and Van Kirk

[57] ABSTRACT

A circular knitting machine, especially of body garment knitting type, has drive arrangements for a pair of rotary cam carriers of conventional lay-out involving a motor, drive shafts and upper and lower gears for the respective cam carriers. Instead of mounting the creel with yarn fast with respect to the upper gear there are provided means mounting the creel coaxially with the ring gears and permitting relative angular movement of the creel and the ring gears, at least one drive abutment for engaging the creel to rotate it conjointly with the ring gears and a shock absorber associated with the creel and the ring gears to thereby permit the creel to overrun the ring gears and move away from the drive abutment on stopping the motor and drive shafts.

6 Claims, 5 Drawing Figures

KNITTING MACHINES HAVING IMPROVED YARN SUPPLY ARRANGEMENTS

FIELD OF INVENTION

The invention relates to knitting machines and in particular circular knitting machines having rotary cam systems on cam carriers and improved yarn supply arrangements. The invention is applicable especially to body-machines for producing fabrics of garment width.

BACKGROUND OF INVENTION

Previously machines having rotary cam systems associated with a cylinder and/or dial have had a creel for mounting yarn packages or bobbins rotatable conjointly with the cam systems. Drive is transmitted from a motor by a drive shaft to an annular gear associated with a lower cam system for a cylinder and hence by a backshaft to an annular gear associated with an upper cam system for a top cylinder or a dial. The creel was fastened rigidly to mounting members of the upper cam system. The dial itself can be shogged to a limited extent for setting up etc.

It is a requirement that body machines can be stopped quickly in the event of mal-function. Stopping may be initiated by an operator. Machines have also many so-called stop-motions to detect a mal-function and stop the machine automatically. Stop motions may detect needle damage or the running out of yarn. In either case it is important that the machine be stopped quickly to minimise needle damage and prevent the pressing-off of the fabric being knitted as a result of which knitting has to be started afresh. To assist quick stopping, the machine may have a brake to arrest the drive shaft and reduce overrunning of the cam systems after the drive has been disconnected or switched off. The cam systems may also have to be slowed or accelerated during knitting for certain operations.

The cam systems are designed to rotate in one direction. Rotation in a reverse direction is not possible and would lead to extensive needle damage.

The requirement for quick stopping of the machine to prevent serious knitting faults has in practice restricted the development of machines with rotary cam systems. If the number or size of yarn packages were to be increased or the number of feeds or knitting speeds to be increased above a certain level, momentum of the rotary masses would increase so that either the cam systems could not be halted sufficiently quickly or, if the brake were applied strongly, distortions in the drive system would occur by distortion of the drive or back shaft. This could be associated with a back lash after braking. As a result of back lash the cam systems move in reverse and occasion mechanical damage. The machine as a whole could also move on the supporting floor as a result of a sudden stop if the machine is not bolted down. More importantly as a result of the mechanism for oscillating the dial or a cylinder can be caused to move to and fro to a small extent within the freedom of movement necessary for the oscillating mechanism sufficiently to cause damage to the knitting instruments by interference between the two sets of needles. Also with double cylinder machines, one cylinder may overrun or turn back to a different extent than the other and damage any needles being transferred from cylinder to cylinder.

It is the object of the invention to provide a knitting machine with rotary cam systems which can be stopped or slowed down quickly and which can rotate at a high speed and/or carry more or bigger yarn packages and/or have more feeds.

BRIEF DESCRIPTION OF INVENTION

A circular knitting machine has drive arrangements for a pair of rotary cam carriers of conventional lay-out involving a motor, drive shafts and upper and lower gears for the respective cam carriers. Instead of mounting the creel with yarn fast with respect to the upper gear there are provided means mounting the creel coaxially with the ring gears and permitting relative angular movement of the creel and the ring gears, a drive abutment for engaging the creel to rotate it conjointly with the ring gears and a shock absorber associated with the creel and the ring gears to thereby permit the creel to overrun the ring gears and move away from the drive abutment on stopping the motor and drive shafts.

The drive and shock absorber can be of simple construction. Preferably the drive abutment is a tapered resilient rubber member and the shock absorber is single acting and has a piston and a piston housing to dissipate energy as the piston slides into the housing and has an automatic resilient return movement of a force insufficient to return the creel when the creel has come to rest at the end of its overrunning movement.

Suitably a rotatable mounting ring supports a circumferentially spaced plurality of supports and a depending support for an upper one of said cam carriers. The creel has radially extending spokes resting freely on said supports to permit angular movement thereon and guide means hold said creel central with respect to the ring gears, the guide means comprising rollers on the creel bearing against the supports.

The relatively simple improvement in creel mounting thus enables considerable advantages to be obtained from the point of view of knitting production.

DESCRIPTION OF PREFERRED EMBODIMENT

Figure 1:
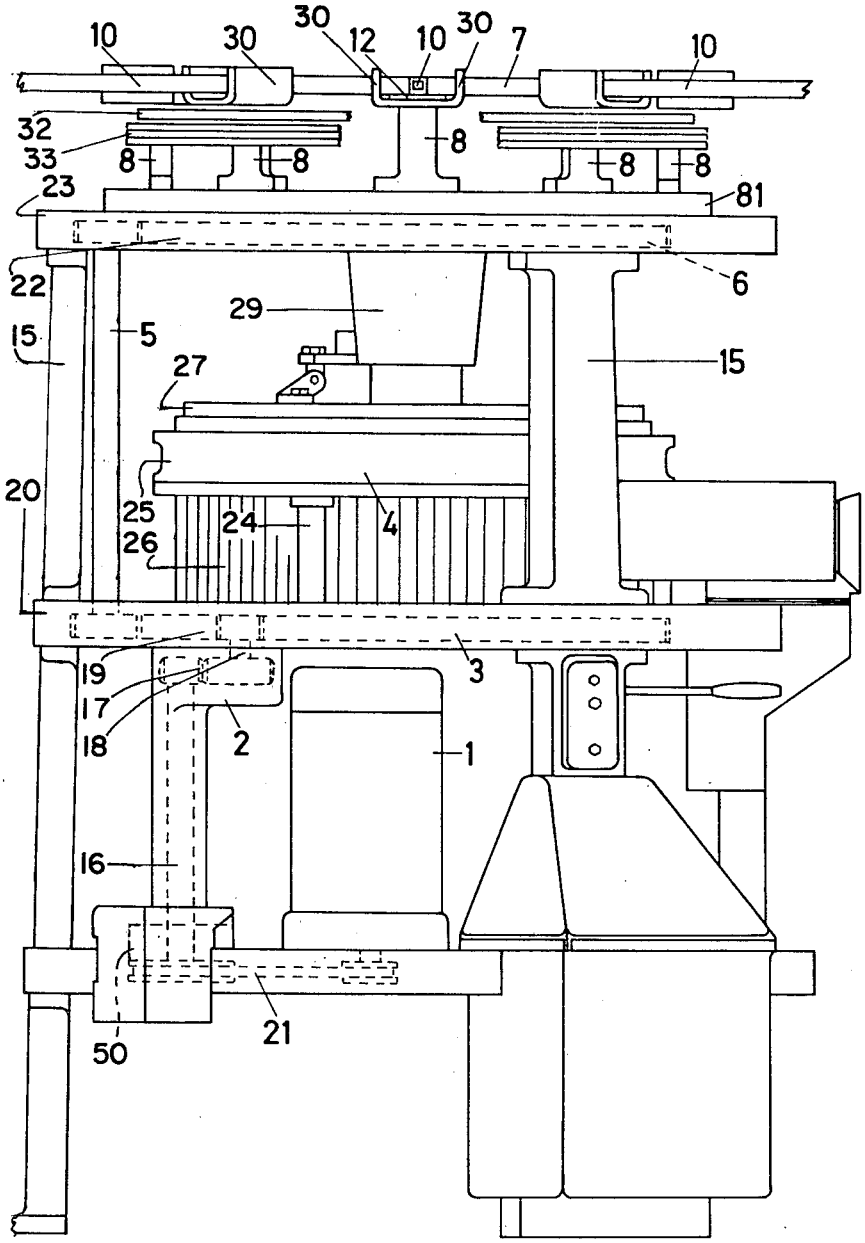
FIG. 1 is a side elevation of a knitting machine showing the mounting of the creel but omitting the shock absorber and creel top structure.

With reference to FIG. 1, a body machine has an exterior frame 15. An electric motor 1 is connected to a V-belt unit to turn a drive shaft 16. A brake 50 is incorporated with the motor 1 and V-belt unit. Brake 50 is operated automatically when the motor 1 is switched off either manually or automatically. The drive shaft 16 rotates an auxiliary shaft 18 through meshing pinions 17. The latter shaft 18 in turn drives an annular ring gear 19 on a middle bed plate 20. The ring gear 19 mounts rods 24 supporting a rotary cam system 25 for a first trick cut member in the form of a stationary needle cylinder 26 which is mounted fixedly to the middle bed plate 20.

A back shaft 5 is meshed through pinions with the annular ring gear 19 and with an annular ring gear 22 in a top bed plate 23. A depending central post mounts a second trick cut member in the form of a dial (not visible in FIG. 1) with respect to the top bed plate 23. The annular ring gear 22 is connected to an inner annular member 81. Downwardly extending member 29 on the inner annular member 81 mount a dial cam system 27 for the dial. The central post can be oscillated by means of an outer ring and inner ring which are connected through sliding dogs in a manner known per se. The annular ring gear 22 and inner annular member 81 assembly carries cams to shift the slidable dogs to create a gap through which yarns can pass. The cams are necessary to permit oscillation of the dial. The arrangement described is known per se.

Figure 4:
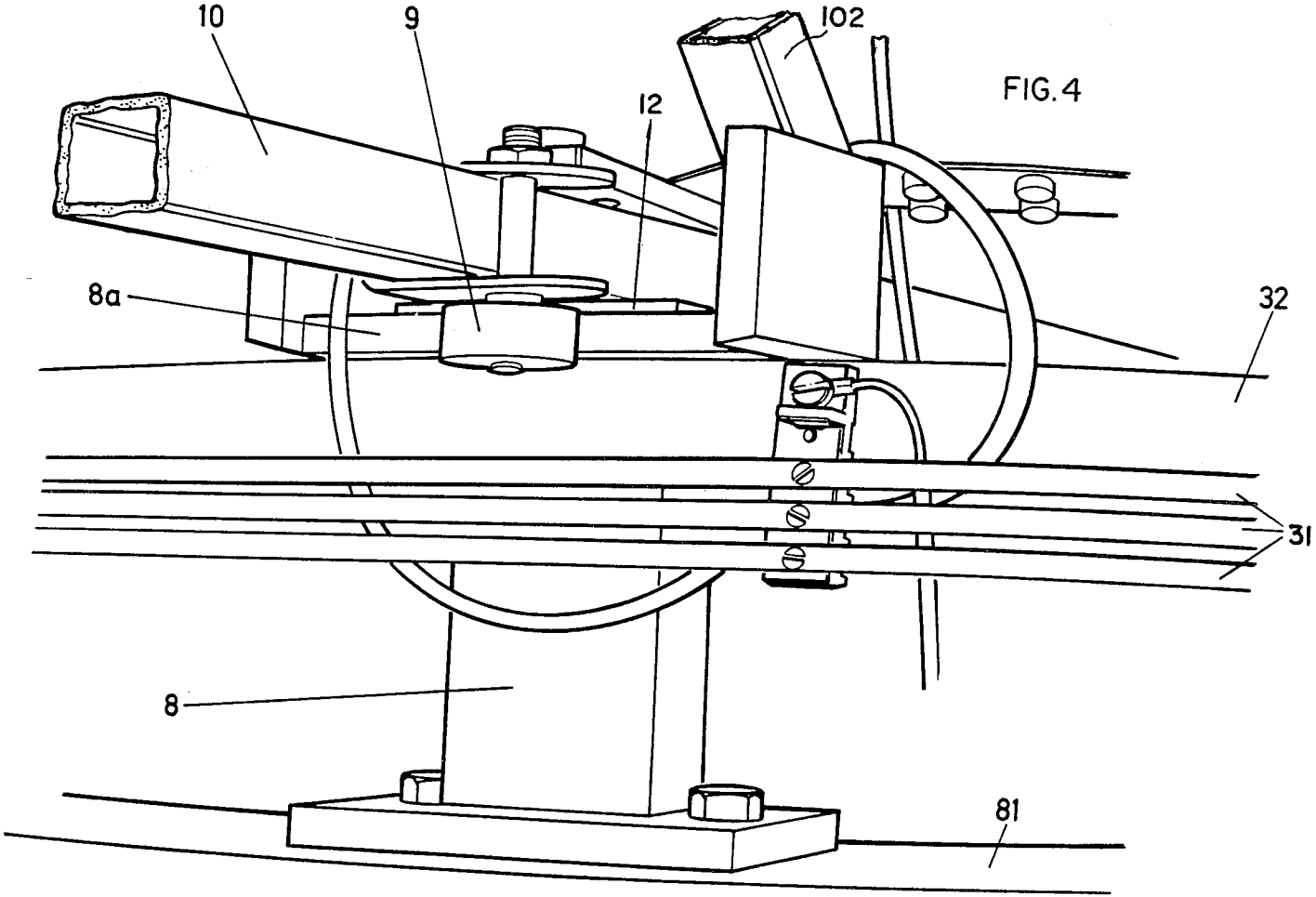
FIG. 4 is a perspective view of a creel-support block without shock absorber.

The inner annular member 81 mounts a creel support arrangement comprising a plurality of creel support blocks 8 with saddles for receiving spokes 10 of a creel indicated generally at 7. Each saddle (see FIG. 4) has a nylon pad 12 on which the appropriate spoke 10 rests with a low coefficient of friction and a pair of side plates 30 at the ends of the pad 12. The spokes 10 are dimensioned with respect to the pads 12 so that the creel can move over a small angle with respect to the inner annular member 81. The spokes 10 or at least 3 block 8 carry wheels 9 (see FIG. 4) which act as guide means and engage bases 8*a* of the creel support blocks 8 so as to center the creel and mount it coaxially with respect to the dial and cylinder.

Figure 5:
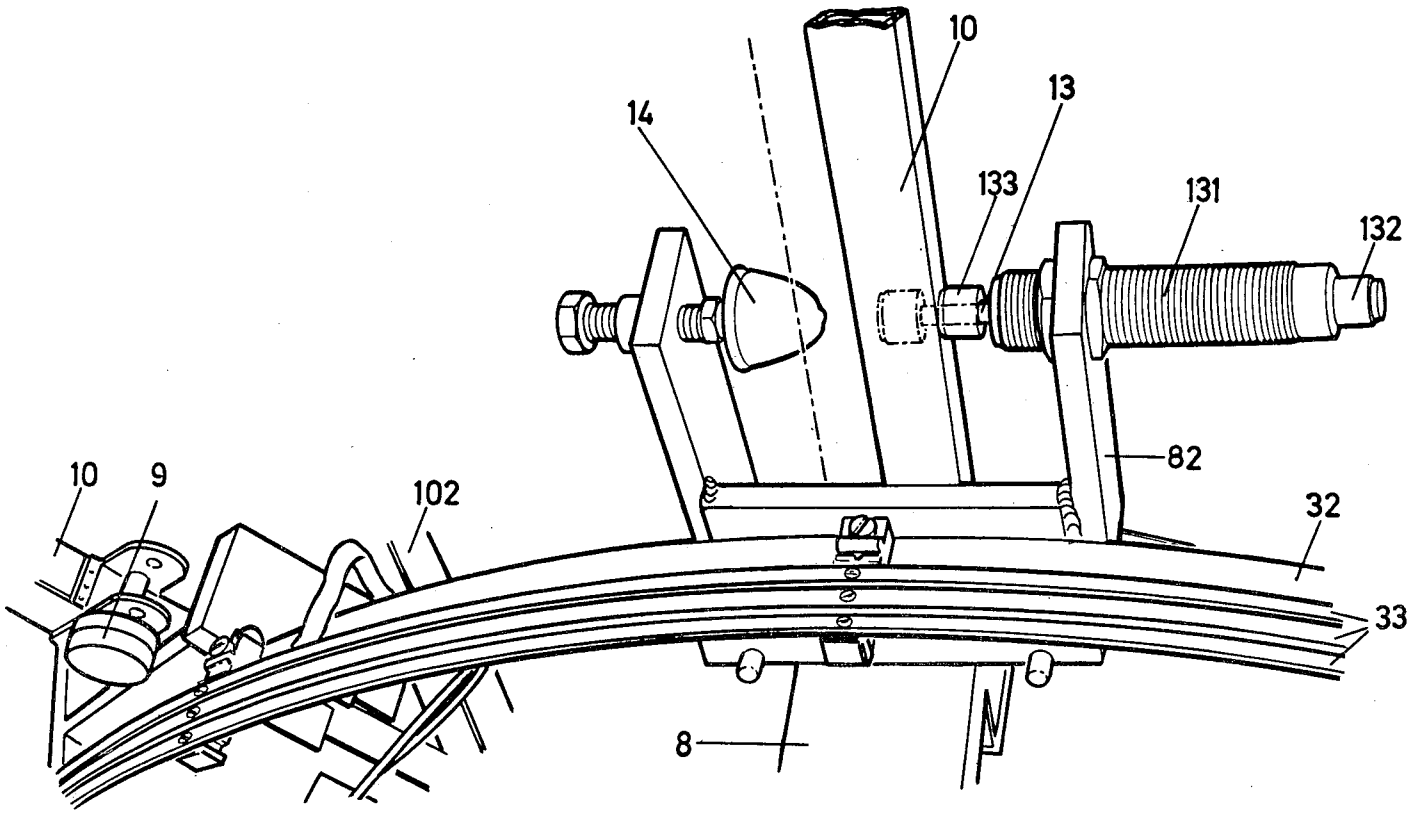
FIG. 5 is a perspective view of a creel-support block with shock absorber.

One spoke 10 does not carry a saddle but is associated (see FIG. 5) with components for controlling the creel motion. A driving abutment or buffer 14, in the form of a tapered, convex rubber stop member, is adjustably mounted on one side of the spoke for driving the creel 7 around during knitting. Two other such buffers are mounted elsewhere. The buffers 14 can be adjusted so that they engage the appropriate spokes 10 simultaneously. A single acting shock absorber, which has a piston 13, is provided with a piston housing 131 fixed to a bracket 82 of another creel support block 8. The piston 13 projects from the housing 131 and has a head 133 of a plastics material for bearing against the spoke 10. The shock absorber may be one made by NRG (Engineering) Ltd. of South Croydon, Great Britain and sold as the Enidine OEM shock. The shock absorber is adjustable at the rear 132 to vary the resistance to movement of the piston 13 but is normally set to provide maximal resistance.

A ring 32 is mounted around the blocks 8. The ring 32 carries a number of electrical contact rings 31 for stop motions and any electrical powered yarn feed devices (not shown).

Figure 2:
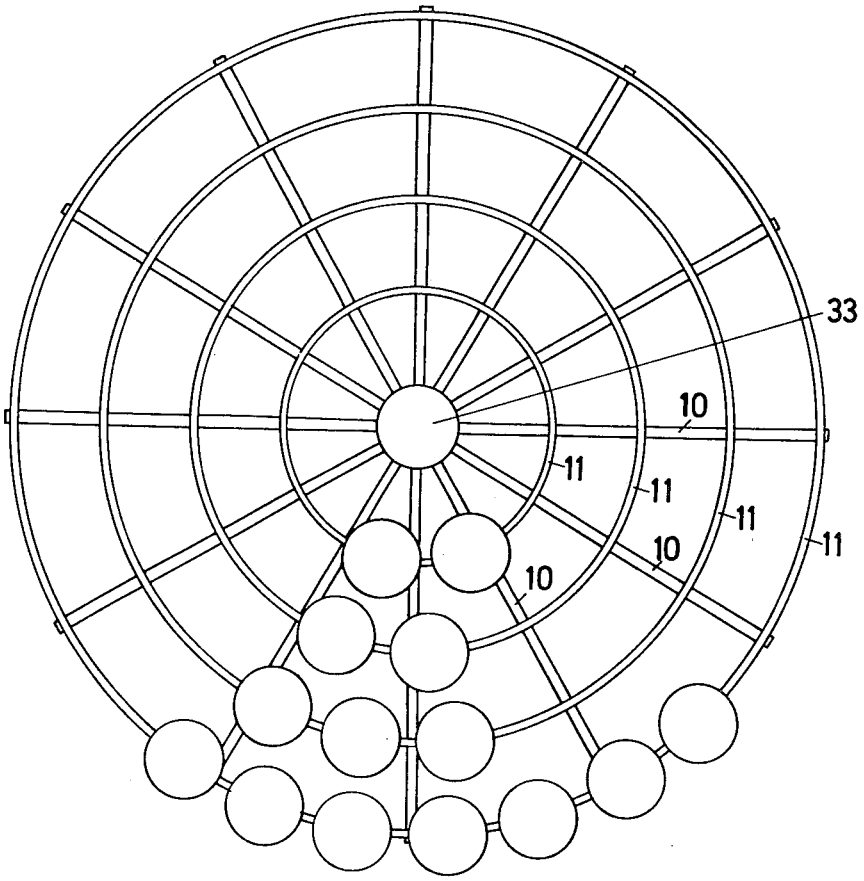
FIG. 2 is a plan of the creel.
Figure 3:
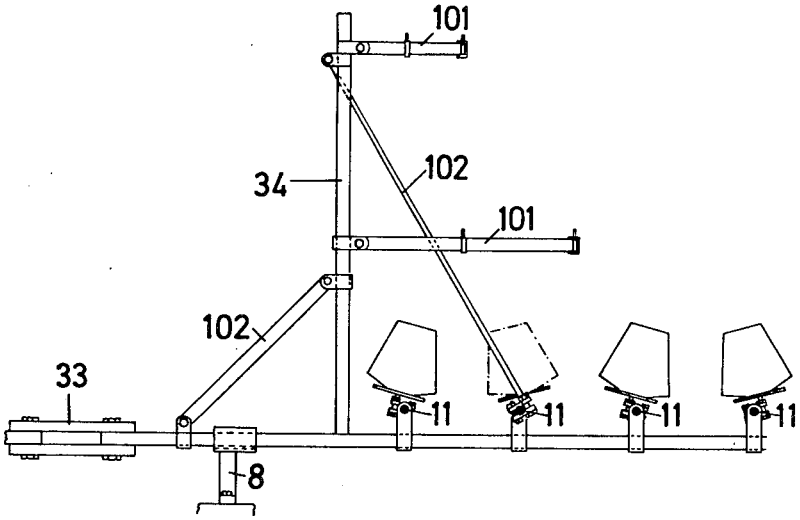
FIG. 3 is a side view of a spoke of the creel.

The creel 7 itself (see FIGS. 2 and 3) comprises a central bracket 33 mounting the radial spokes 10 and a plurality of bobbin-support rings 11. The spokes 10 are cantilevered radially outwardly of the creel support blocks 8. Posts 34 (see FIG. 3) are mounted on the spokes 10 and connected by ties 102 to radially inward and outward positions on the spokes 10. Upper spokes 101 on the posts 34 mount yarn guide eyes and stop motions (not shown) for stopping the machine when yarn runs out.

In operation with a full load of bobbins, the creel 7 develops considerable momentum. The driving buffers 14 are slightly compressed and cause the creel 7 to rotate bodily with the cam systems 25 and 27. The head 133 bears against the spoke 10 and is in the position shown in dotted lines in FIG. 5 as a result of a resilient return movement of the piston 13. The shock absorber is adjusted to provide a large resistance.

When a stop motion detects a yarn breakage or the running out of yarn or the machine is to stop for some other reason, the motor 1 is disconnected and the brake applied. The cam systems 25 and 27 are stopped as a result in a very short time. As a result of the momentum built up in the creel 7, the spoke 10 bearing against the head 133 disengages the associated drive buffer 14 and starts to push the piston 13 into the housing. The result is that the creel 7 continues to rotate and overruns the cam systems by a small angular movement and decelerates over a longer period than the cam systems 25 and 27. Whilst decelerating a continuous force is applied to the inner annular member 81 which tends to urge the cam systems to continue travel in the direction of their usual rotation but which is overcome by the brake force and friction between cam systems and the needles and other knitting instruments.

When the creel 7 has stopped, a mechanic can effect the necessary repairs or ensure a proper supply of yarn. During the period the creel 7 remains in its terminal position shown in solid lines in FIG. 5. The resilient force urging a return of the piston head 133 is insufficient to displace the creel 7.

On restarting the machine, the motor 1 is re-connected and the brake released. The cam systems 25 and 27 resume their motion quickly. The inertia of the creel 7 causes its movement to be retarded. The spoke 10 thus lands against the drive buffer 14 after a slight delay following which event the resilient force in the shock absorber causes it to return to the position shown in dotted lines in FIG. 5.

Where the creel 7 is lightly loaded, the resistance to movement of the shock absorber may be reduced so as to ensure a gradual deceleration of the creel. The shock absorber should be adjusted to give such a gradual deceleration without the piston 13 bottoming out and coming abruptly to the end of its stroke.

Using such a creel-mounting, a single inexpensive shock absorber provides for smooth stopping and starting of the knitting machine even when the creel rotates rapidly or carries a heavy yarn load. The brake can be applied vigorously to stop the cam system rotation promptly even at high speeds. Distortion in the drive system during stopping and starting can be reduced. Movement of the cam systems in a reverse direction as a result of back lash can be avoided. Slowing down is effected smoothly. Excessive to and fro movement of the dial by cam sliding dog interference is avoided.

The mechanism may be modified by providing more shock absorbers or by providing shock absorbers which resist motion in either direction, although the preferred arrangement provides a particularly quick, and simple construction which is quite adequate for the purposes of the invention. The invention removes an important hindrance to further production increases on rotary cam system circular knitting machines of the dial and cylinder and superimposed double cylinder type and facilitates the prompt stopping of cam systems. It is important to appreciate that other systems for gradually decelerating creels will not work as well as the invention or even make the drive worse overall if resilient components are used to significantly assist decleration. It has been found that spring systems give rise to vibration and may increase backlash under certain circumstances. The invention ensures gradual deceleration and reduces acceleration load by permitting the creel 7 to remain in an over-travelled position, past its usual drive position, when the machine is stopped.

We claim:

1. Circular knitting machine comprising upper and lower members having tricks cut therein for holding needles, a pair of cam systems rotatable around respective of said upper and lower members to slide needles in the tricks, upper and lower angular ring gears drivingly connected to the respective cam systems, a motor and drive shafts for rotating the upper and lower ring gears simultaneously, a creel for carrying yarn packages, means mounting the creel coaxially with the ring gears and permitting relative angular movement of the creel and the ring gears, at least one drive abutment for engaging the creel to rotate it conjointly with the ring gears and a shock absorber associated with the creel and the ring gears to thereby permit the creel to overrun the ring gears and move away from the drive abutment on stopping the motor and drive shafts.

2. Circular knitting machine as claimed in claim 1 wherein the drive abutment is a tapered resilient rubber member.

3. Circular knitting machine as claimed in claim 2 wherein the shock absorber is single acting and has a piston and a piston housing to dissipate energy as the piston slides in the housing and has an automatic resilient return movement of a force insufficient to return the creel when the creel has come to rest at the end of its overrunning movement.

4. Circular knitting machine as claimed in claim 1 wherein a rotatable mounting ring supports a circumferentially spaced plurality of supports and a depending support for a cam system associated with said upper trick cut member, the creel having radially extending spokes resting freely on said supports to permit angular movement thereon and said machine further including guide means for holding said creel central with respect to the ring gears.

5. Circular knitting machine as claimed in claim 4 wherein the guide means comprise rollers on the creel bearing against the supports.

6. A circular knitting machine comprising a pair of members having tricks cut therein for holding needles, a pair of cam systems rotatable around the respective trick cut members to slide needles in the tricks, an upper and a lower annular ring gear drivingly connected to respective of the cam systems, a motor, drive shaft means operatively coupling said motor to said ring gears for rotating the upper and lower ring gears simultaneously, a creel for carrying yarn packages, brake means for arresting said drive shaft means, a rotatable mounting ring which supports a circumferentially spaced plurality of supports and a depending support for an upper cam system for one of said trick cut members, wherein the creel has radially extending spokes resting freely on said supports to permit angular movement thereon and guide means for holding said creel central with respect to the ring gears, a drive abutment on at least one of the supports for engaging one of the spokes of the creel to rotate it conjointly with the ring gears, and a shock absorber interposed between at least one of the supports and one of the spokes to thereby permit the creel to overrun the ring gears and move away from the drive abutment upon arresting the drive shaft means.

* * * * *